US007531972B1

(12) United States Patent
Worsham et al.

(10) Patent No.: US 7,531,972 B1
(45) Date of Patent: May 12, 2009

(54) ROTATABLE REMOTE CONTROLLED PORCH LIGHT

(76) Inventors: David Worsham, 3145 Hwy. 77, Columbiana, AL (US) 35051; Wang Mao-Shen, 4F., No. 3, Alley 16, Lane 235, Bau Chiou Rd., Hsin-Tien City 231 (TW)

( * ) Notice: Subject to any disclaimer, the term of this patent is extended or adjusted under 35 U.S.C. 154(b) by 28 days.

(21) Appl. No.: 11/598,336

(22) Filed: Nov. 13, 2006

(51) Int. Cl.
*H01K 1/62* (2006.01)

(52) U.S. Cl. ..... 318/16; 362/233; 362/368; 362/372

(58) Field of Classification Search ..... 318/16; 362/145, 147, 233, 276, 368–372
See application file for complete search history.

(56) References Cited

U.S. PATENT DOCUMENTS 5,673,989 A * 10/1997 Gohl et al. ..... 362/35
6,484,456 B1 * 11/2002 Featherstone et al. ..... 52/118
6,655,817 B2 * 12/2003 Devlin et al. ..... 362/233
6,955,447 B2 * 10/2005 Lui ..... 362/233
7,261,442 B2 * 8/2007 Chiu ..... 362/372
2005/0243549 A1 * 11/2005 Ruston ..... 362/233

* cited by examiner

*Primary Examiner*—Bentsu Ro
(74) *Attorney, Agent, or Firm*—Gerald M. Walsh; Kenneth M. Bush; Bush Intellectual Property Law

(57) ABSTRACT

A remote controlled porch light that has a rotating seat on a base seat, and a rotation driving seat fitting within the base seat. The rotation driving seat has a first reversible motor to rotate the rotation driving seat and lamp to the left or right. A movable lamp holder is attached rotatably to the rotation driving seat. The rotation driving seat has a second reversible motor to rotate the movable lamp holder and lamp up or down. One or more stopper pins in the rotation driving seat limit the degree of horizontal rotation of the rotation driving seat. The base seat is adjustable on an adjusting board to position the light within the center of its arc of rotation, allowing the stopper pins to limit the degree of rotation of the light so that the rotation will not damage the lamp or the house or building to which the light is attached.

7 Claims, 8 Drawing Sheets

ROTATABLE REMOTE CONTROLLED PORCH LIGHT

BACKGROUND OF THE INVENTION

1. Field of the Invention

The present invention relates to porch lights, and, more particularly, to a wireless remote controlled porch light having a rotation driving seat to turn the light source horizontally and vertically, stop devices to limit the degree of horizontal and vertical rotation, and an adjusting board to center the light between the light's extremes of horizontal rotation.

2. Technical Background

Normally the porch light for a building or house is installed on the outer wall or under the eaves, and has a light beam aimed in a fixed direction to illuminate a fixed area. With existing porch lights or flood lights, however, it is impossible to make immediate changes in the direction of the light beam. Conventional porch lights and flood lights popularly used today are unable to have the direction of the light beam varied or turned on and off by means of radio frequency (RF) remote control at any time whenever required by a user. Although lights can be made to rotate, the degrees of rotation needs to be accurately controlled or the light may rotate into the structure to which it is attached and damage the structure and/or the light. What is needed is a remote controlled porch or flood light that can be varied remotely by a hand held transmitter to change the horizontal and vertical direction of the light source without damaging the light or the building to which the light is attached.

SUMMARY OF THE INVENTION

The remote controlled light of the present invention has a circular base seat with a circular fixed seat having an internal ring gear attached to the base seat. Between the base seat and the fixed seat is a rotating connecting seat which rotates freely on the base seat and the fixed seat. A rotation driving seat fits within the base seat and connects to the rotating connecting seat so that the rotation driving seat can rotate freely within the base seat around its axis in a horizontal direction. A lamp holder is attached rotatably to the rotation driving seat so that the lamp holder can rotate about its axis of rotation in a vertical direction. The rotation driving seat has a first reversible rotation motor with a driving gear that engages the internal ring gear in the fixed seat so that the reversible rotation motor will turn the rotation driving seat horizontally to the left or to the right as the driving gear is turned by the first motor. The rotation driving seat has a second reversible rotation motor with a driving gear that engages a circular gear rack on the lamp holder to rotate the lamp holder vertically up and down as the driving gear is turned by the second motor. The rotation driving seat and the lamp holder have stopper pins to limit the degree of rotation of the light so that it will not damage, or be damaged by, the structure to which it is attached. In order to set the light on the structure so that it is centered within the arc of its horizontal rotation, the light has an adjusting board which attaches to a structure and which interfaces between the base seat and the structure to which the base seat is to be attached. Thus, the adjusting board is first attached to the structure and then the base seat is attached rotatably to the adjusting board. The base seat can then be rotated as desired to center the light within its arc of horizontal rotation, and then the base seat can be fastened to the adjusting board so as not to rotate. The rotation driving seat also has a receiver to receive RF signals remotely from a hand held transmitter to control the electric power to the lamp or the drive motors. The rotation driving seat can have other electronic devices for monitoring, surveillance, videoing, and for wireless transmission of signals to any desired communication network. An advantage of the porch light of the present invention is a light that can be controlled remotely to turn the lamp on and off and to rapidly change the direction of the light beam in both the horizontal and vertical directions.

Another advantage is the use of a rotating connecting seat between the base of the light and a rotating drive seat so that the rotating drive seat and lamp holder can rotate independently of the base, allowing for a compact design of the light while providing a large degree of horizontal and vertical rotation of the lamp.

Another advantage is a system of stopper pins that limit the degree of rotation of the lamp in the vertical and horizontal directions so that rotation of the lamp will not damage the lamp or the house or building to which it is attached.

Another advantage is an adjusting board used to attach the base seat to the house or building to allow the base seat to be rotated so as to position the light within its center of rotation before final fixation of the light to the house or building.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
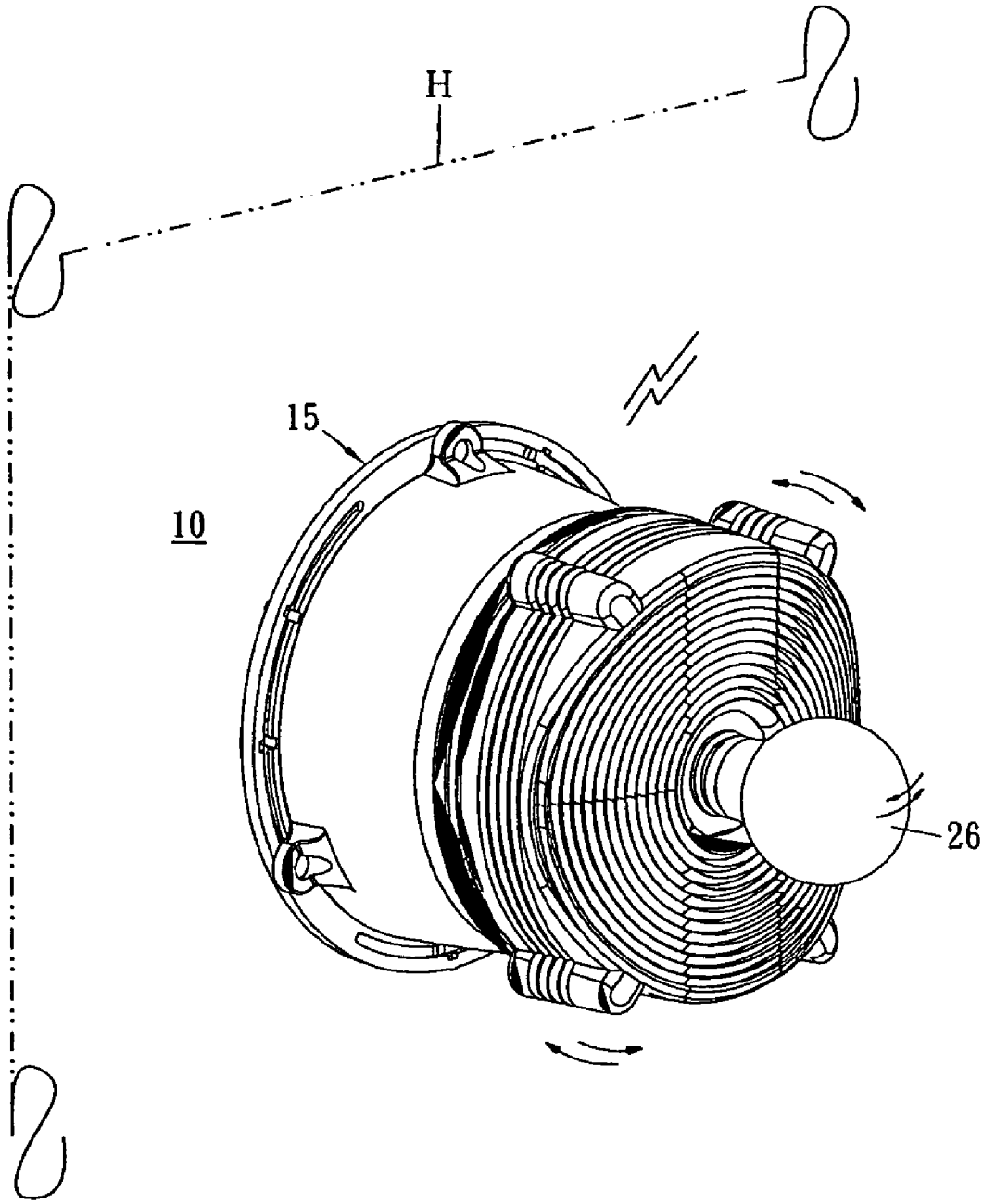
FIG. 1 illustrates the external features of the porch light of the present invention attached to a structure such as a house or building.

Referring to FIG. 1, a porch light 10 of the present invention can be installed on an outer wall or under the eaves of a home or building H, and can be turned on or off by means of a manually operated RF transmitter for illuminating an area around the home or building H. The direction of the light's beam may be changed and controlled also by means of a manually operated RF transmitter.

Referring to FIGS. 2-7, the porch light 10 has an adjusting board 15 which has plural ring-slots 16 and a penetrating hole 17 formed on its surface. The adjusting board 15 is securely fastened and installed on the outer wall or under the eaves of a home or building H. After installation of the adjusting board 15 is complete, an electric cable 18 having three sets of wires to transmit electric power is passed through the penetrating hole 17 and connected to the wireless remote control porch light 10. Each of the ring-slots 16 formed on the adjusting board 15 are provided for coupling a pair of pivot bolts 19*a* and pivot nut 19*b* to build a pivotal connection formed between the porch light 10 and the adjusting board 15. Thus, the porch light 10 may be adjustably installed in a preferable position relative to the house or building H through the pivot bolt 19*a* being loosened, the base seat 80 being slid along the ring-slots 16 to have the porch light 10 adjustably rotated to a preferable position, and then fastened so that base seat 80 does not rotate. The porch light 10 has a waterproof rubber sleeve or seal 20, a movable lamp holder 30, a rotation driving seat 40, a pair of shaft covers 50, a fixed seat 60, a rotation connecting seat 70, and a base seat 80.

The waterproof rubber sleeve 20 is installed in such a way that the mounting hole 22 on the body 21 of the waterproof rubber sleeve 20 is fitted into the ring-shaped groove 36 on the upper housing 31 of the movable lamp holder 30, and the shielding covers 24 of the body 21 of the waterproof rubber sleeve 20 are installed on the connecting portions 44 of the rotation driving seat 40. The flange 23 of the waterproof rubber sleeve 20 is inserted into the groove 73 on the rotation connecting seat 70.

When the rotation driving seat 40 and the rotation connecting seat 70 rotate synchronously in clockwise and counter clockwise direction, the waterproof rubber sleeve 20 can move following the motion of the rotation driving seat 40 and the rotation connecting seat 70. Also, when the movable lamp holder 30 pivotally mounted in the recession 42 of the rotation driving seat 40 swivels, the waterproof rubber sleeve 20 with plaited structure F can flexibly extend and contract following the motion of the movable lamp holder 30. By employing the waterproof rubber sleeve 20, water can be prevented from seeping into the porch light 10.

Figure 2:
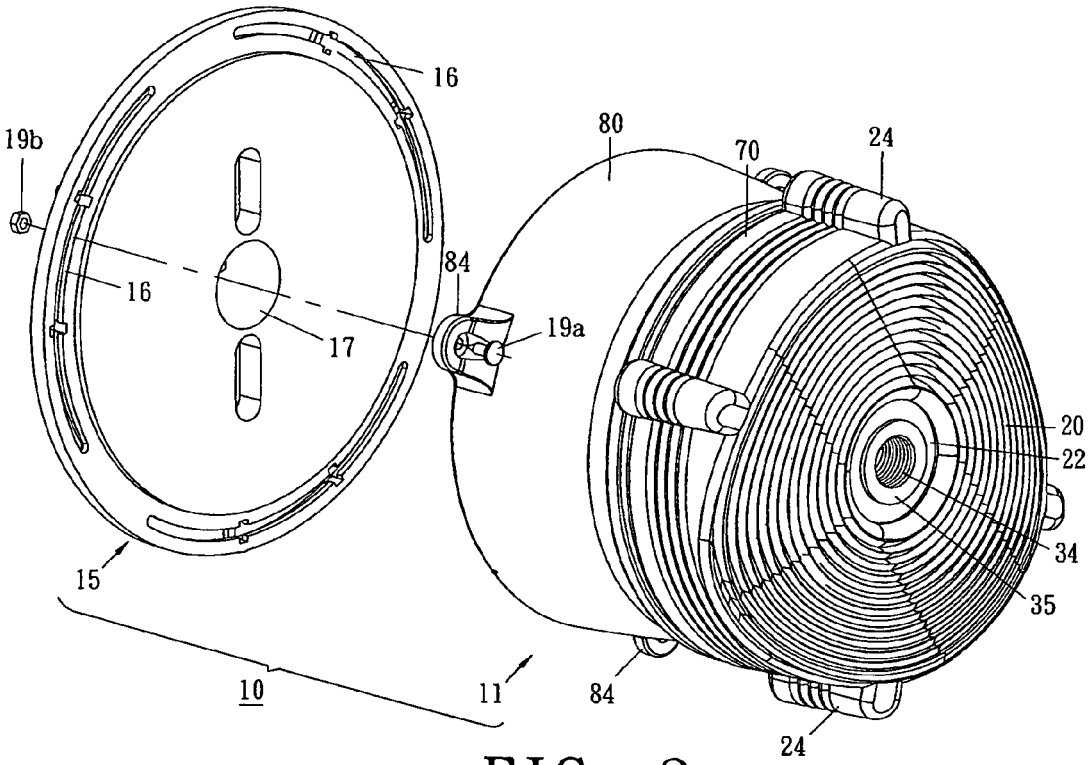
FIG. 2 illustrates the adjusting board, base seat, rotating connecting seat, and waterproof sleeve of the porch light.
Figure 5:
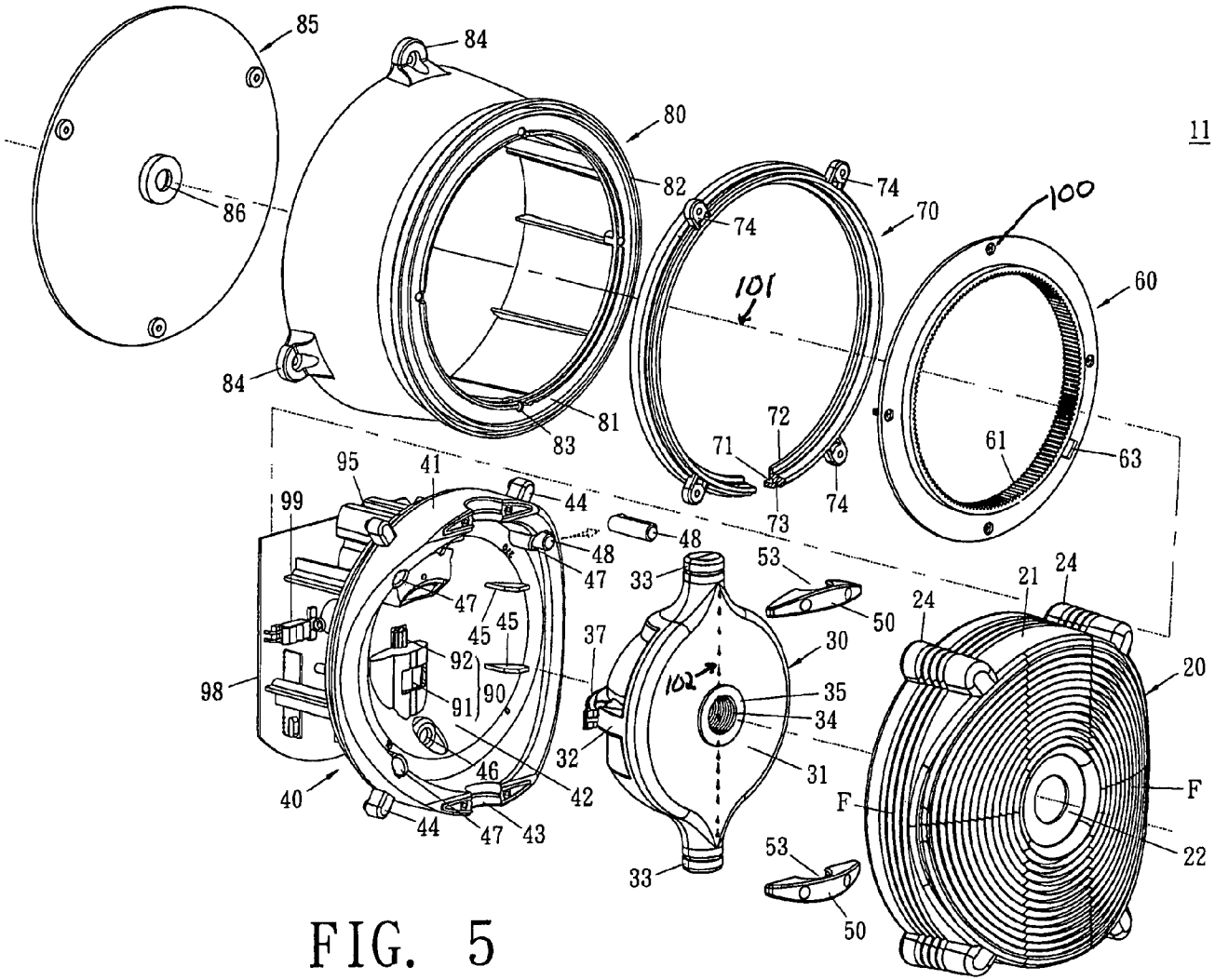
FIG. 5 is an exploded drawing of the porch light showing the relation between each part for being assembled together.
Figure 7:
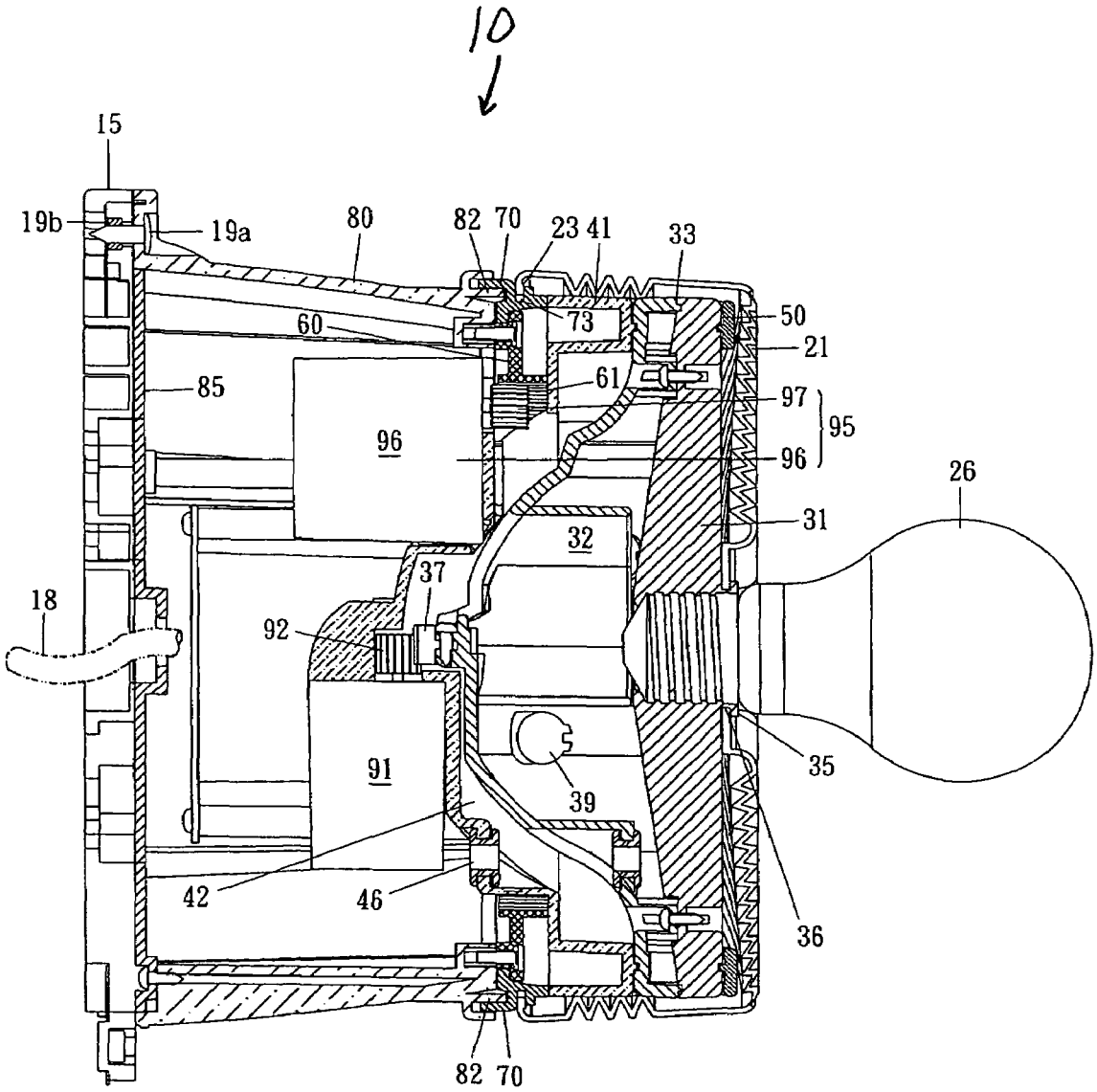
FIG. 7 is a cross-sectional view of the porch light.

As shown in FIGS. 5 and 7, the fixed seat 60 and the rotation connecting seat 70 are jointly installed on the base seat 80, but the rotation connecting seat 70 is a movable part which is mounted on the base seat 80 by means of the fixed seat 60 to form a pivotal connection between the rotation connecting seat 70 and the base seat 80. The rotation connecting seat 70 thus rotates around the edge of the base seat 80. The base seat 80 is a hollow housing which has a ring-shaped groove 81 and a ring-shaped rib 82 formed on the top surface. The base seat 80 has several fastening holes 83 further formed in the ring-shape groove 81. On the bottom side of the base seat 80 is a bottom cover 85 which has a penetrating hole 86 through which the electric cable 18 is connected to the inner side of the base seat 80, and plural protruding portions 84 are formed along the outer edge of the bottom surface of the base seat 80 as shown in FIGS. 1, 2 and 5. By employing the protruding portions 84 on the base seat 80, porch light 10 will have a pivotal connection to the adjusting board 15 when the pivot bolts 19*a* are passed through the protruding portions 84 and the corresponding ring-slots 16 of the adjusting board 15, and then coupled to the related pivot nut 19*b*. After installation of the pivot bolts 19*a* and the pivot nuts 19*b* is completed, the porch light 10 is installed on the outer wall or under the eaves of home or building H so as to center the base seat 80 as desired.

The rotation connecting seat 70 is a ring-shaped part which has a sliding groove 71 and an inner flange 72. The sliding groove 71 is designed to fit the ring-shaped rib 82 of the base seat 80, and maintain a pivotal connection between the base seat 80 and the rotation connecting seat 70. The rotation connecting seat 70 further has a groove 73 formed circularly on its outer surface, and has plurality of connecting portions 74.

The fixed seat 60 is also a ring-shaped part having an internal ring gear 61. The fixed seat 60 is installed on the base seat 80 by fastening screws 100 through the holes 83 on the base seat 80. Since the rotation connecting seat 70 and the fixed seat 60 both are assembled together and jointly installed on the base seat 80, the fixed seat 60 can prevent separation of the rotation connecting seat 70 from the base seat 80. The fixed seat 60 enables a pivotal connection between the base seat 80 and the rotation connecting seat 70, so that the rotation connecting seat 70 can move in rotating motion relative to the fixed seat 60 and the base seat 80, around the central axis 101 of these structures.

The rotation driving seat 40 has a body 41 and a recession 42 formed within the body 41 for accommodating and installing the movable lamp holder 30. There are two semicircular shaft holes 43 which are oppositely formed on both sides of the body 41 for mounting the pair of pivotal shafts 33 of the movable lamp holder 30. A pair of shaft covers 50 having semicircular shaft holes 53 are correspondingly installed to fit the semicircular shaft hole 43 of the rotation driving seat 40 for mounting the pair of pivotal shafts 33 of the movable lamp holder 30, forming a pivot connection with the rotation driving seat 40 to enable the lamp holder 30 to make a rotating motion in the recession 42 of the rotation driving seat 40.

On the back side of the body 41 of the rotation driving seat 40 are a swivel driving means 90, an axial rotation driving means 95, and a printed circuit board 98 carrying a radio signal receiver 99. The swivel driving means 90 has a reversible rotation motor 91 and a driving gear 92 which engages the circular gear rack 37 on the back side of the lower housing 32 of the movable lamp holder 30.

The recession 42 of the rotation driving seat 40 has a passage 46 for one set of wires of the electric cable 18 to pass through and connect to the light bulb 26 on the movable lamp holder 30. When the movable lamp holder 30 moves, the passage 46 of the rotation driving seat 40 prevents tangling of the electric cable 18.

The axial rotation driving means 95 of the rotation driving seat 40 has a reversible rotation motor 96 and a driving gear 97. When the rotation driving seat 40 and the rotation connecting seat 70 are installed together to form a complete unit, the swivel driving means 90, the axial rotation driving means 95 and the radio signal receiver 99 are located inside the base seat 80, and the driving gear 97 of the axial rotation driving means 95 engages with the internal ring gear 61 of the fixed seat 60.

The waterproof rubber sleeve 20 is a flexible part having a cover-shaped body 21 which has its top and side surface formed into plaited structure F. On the outer side of the body 21 of the waterproof rubber sleeve 20 are plural shielding covers 24 corresponding to the connecting portions 44 of the rotation driving seat 40. On top side of the body 21 of the waterproof rubber sleeve 20 is a a mounting hole 22, and along the inner edge of bottom side of the body 21 is an inner flange 23.

Figure 6:
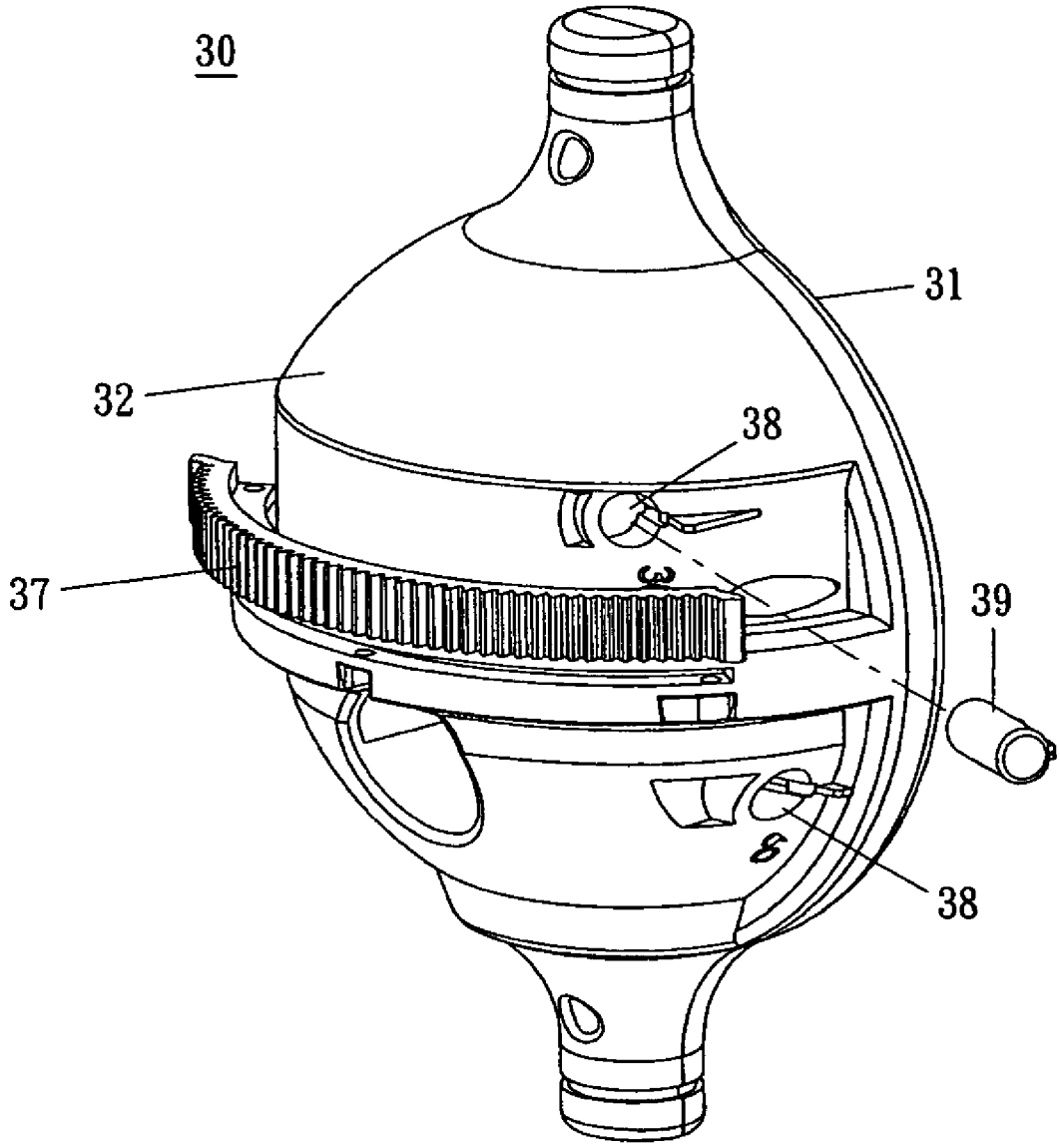
FIG. 6 is a rear view of the movable lamp holder.

Referring to FIGS. 5 and 6, the rotation driving seat 40 may further have two or more stopper ribs 45 located inside the recession 42 of the body 41. The lower housing 32 of the movable lamp holder 30 has one or more positioning holes 38 located at different angular positions. When the movable lamp holder 30 swivels about its axis 102, a stopper pin 39 inserted in the movable lamp holder 30 will stop at the stopper rib 45 to limit swivel displacement of the movable lamp holder 30. Therefore, by selectively inserting the stopper pin 39 in different positioning holes 38 of the movable lamp holder 30, the illumination angle of the porch light 10 can be limited within a selected vertically angular range corresponding to the stopper pin 39.

The maximum degree of vertical rotation of the movable lampholder 30 is, preferably, about 60 degrees. The axis of rotation 102 of the movable lamp holder 20 is, preferably, perpendicular to the axis of rotation 101 of the rotation driving seat 40.

Referring to FIGS. 3 to 7, the movable lamp holder 30 comprises an upper housing 31 and a lower housing 32 which mutually form pivotal shafts 33 on both sides of the movable lamp holder 30. The upper housing 31 has a light bulb socket 34 which is connected to one set of wires of the electric cable 18 which is extended into the base seat 80 to form an electric connection for supplying electric power to a light bulb 26. On the top side of the upper housing 31 a flange 35 is provided to form a ring-shaped groove 36. The back side of the lower housing 32 has a curved surface which carries a circular gear rack 37.

Figure 4:
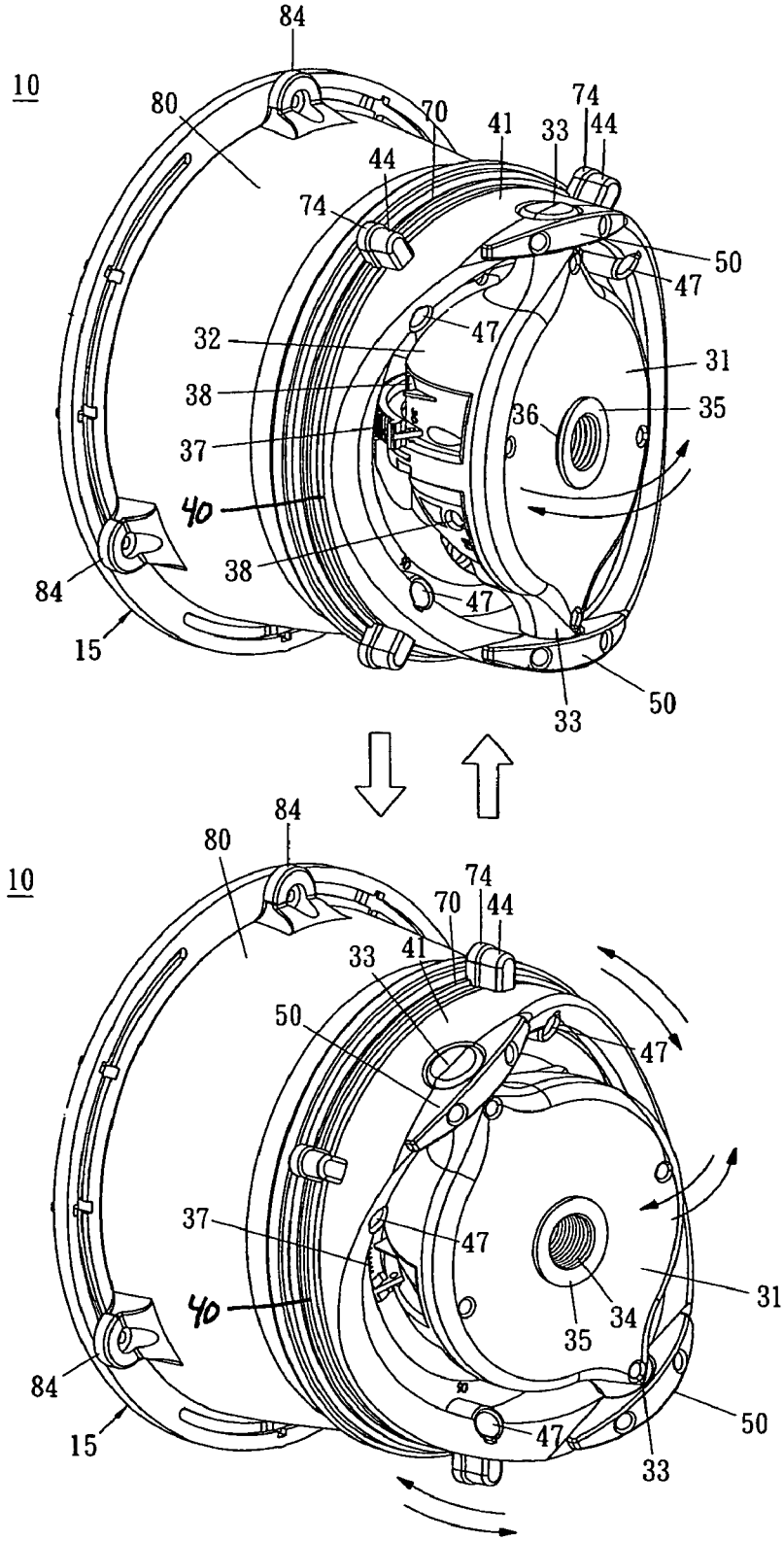
FIG. 4 is an illustration showing the vertical rotation of the lamp holder and the horizontal rotation of the rotation driving seat.

Referring to FIGS. 4 and 7, the reversible rotation motor 91 of the swivel driving means 90 is connected to one set of wires of the electric cable 18 extending into the base seat 80 to form electrical connections. By employing the reversible rotation motor 91, the movable lamp holder 30 can be driven by the driving gear 92 to move angularly in forward and backward direction (vertical, or up and down direction) in the recession 42 of the rotation driving seat 40 to vary the illumination angle of the porch light 10.

Figure 3:
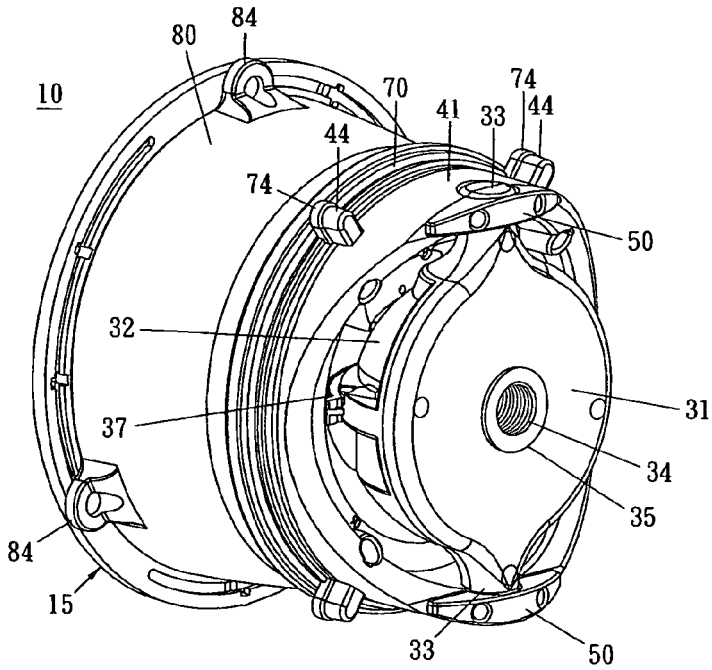
FIG. 3 shows the porch light with the waterproof rubber sleeve removed, revealing the body of the rotation driving seat and the lamp holder.

Referring to FIGS. 3 to 5, on the outer side of the body 41 of the rotation driving seat 40 are plural connecting portions 44 corresponding to the connecting portions 74 of the rotation connecting seat 70. By installing together the connecting portions 44 and the connecting portions 74, the rotation driving seat 40 and the rotation connecting seat 70 can be assembled together to form a complete unit interlinked with each other.

Referring to FIGS. 4 and 6, one set of the electric cables 18 inside the base seat 80 is connected to the reversible rotation motor 96 to form an electric connection. Since the fixed seat 60 is an immovable fixed part, the driving gear 97 on the reversible rotation motor 96 can drive the rotation driving seat 40 and the rotation connecting seat 70 to rotate synchronously as a whole unit in a clockwise and counter clockwise direction around base seat 80 to vary the angle of the light beam, jointly with the swivel driving means, to vary the illumination angle.

As shown in FIGS. 1 and 5, when the radio signal receiver 99 receives an RF signal emitted by the RF signal emitter from a distance, the light bulb 26 of the porch light 10 may be turned on and off, by controlling the power supplied through one set of wires of the power cable 18. The illumination angle of the porch light 10 can be varied by the RF signal emitter in up or down vertical and left or right horizontal directions to control and move the light beam of the wireless remote control porch light 10 as desired.

Referring to FIG. 5, another embodiment of the wireless remote control porch light 10 is two or more holes 47 for selectively inserting stopper pins 48 within body 41 of the rotation driving seat 40. The fixed seat 60 has a stopper block 63 formed on its top side facing the rotation driving seat 40 so that when the rotation driving seat 40 rotates about its center line 101, the stopper pin 48, inserted in the hole 47 in the rotation driving seat 40, will stop at the stopper block 63 to limit the degree of horizontal rotation of the rotation driving seat 40. Therefore, by inserting the stopper pin 48 on different holes 47 located at different positions on the rotation driving seat 40, the illumination angle of the porch light 10 is then limited within a selected horizontally angular range corresponding to the position of the stopper pin 48.

As depicted in FIG. 7, the electric power for the wireless remote control porch light 10 is supplied through the electric cable 18 which has three sets of wires, and, each set of wires is respectively connected to three channels of the radio signal receiver 99 to form an electric connection, so that one set of wires of the electric cable 18 is connected to the light bulb socket 34 of the movable lamp holder 30 for supplying power to the light bulb 26, and another two sets of wires of the electric cable 18 are connected to the two reversible rotation motors 91 and 96 separately for supplying power to the reversible rotation motors 91 and 96.

Figure 8A:
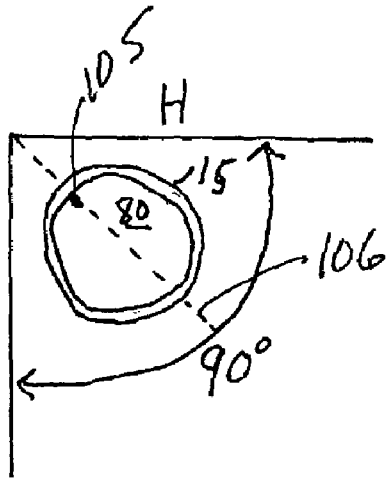
FIGS. 8*a-c* illustrate the various mounting positions of the light on a house or building using the adjusting board to center the light within the horizontal arc of the rotation of the rotation driving seat.
Figure 8B:
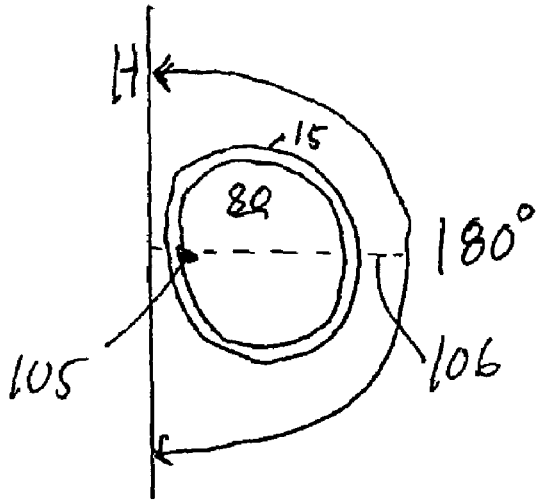
Figure 8C:
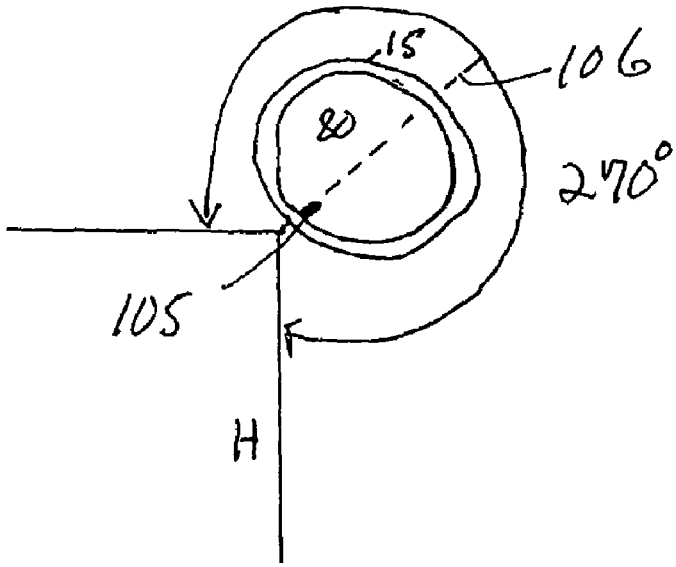

FIGS. 8*a-c* illustrate the positioning of the porch light 10 in conditions in which a variety of horizontal rotations of the base seat 80 about its central axis 101 (see FIG. 5) are required. In FIG. 8*a*, the porch light 10 is positioned in an inside corner where a 90 degree angle of rotation is desired. A stopper pin 48 is inserted into a hole 47 on the rotation driving seat so that the angle of rotation of the base seat 80 is limited to 90 degrees. The center of this rotation (radius 106) of the base seat 80, shown at point 105, is aligned opposite the inside corner of the building H by rotating the base seat 80 on the adjusting board 15. The base seat 80 is then firmly fixed to the adjusting board 15. As the rotation driving seat 40 rotates right or left the lamp 26 will not contact the walls forming the inside corner.

In FIG. 8*b*, the porch light 10 is positioned on a flat wall where a 180 degree angle of rotation is desired. A stopper pin 48 is inserted into a hole 47 on the rotation driving seat so that the angle of rotation of the base seat 80 is limited to 180 degrees. The center of this rotation (radius 106) of the base seat 80, shown at point 105, is aligned directly opposite the wall of the building H by rotating the base seat 80 on the adjusting board 15. The base seat 80 is then firmly fixed to the adjusting board 15. As the rotation driving seat 40 rotates right or left the lamp 26 will not contact the wall.

In FIG. 8*c*, the porch light 10 is positioned on an outside corner where a 270 degree angle of rotation is desired. A stopper pin 48 is inserted into a hole 47 on the rotation driving seat so that the angle of rotation of the base seat 80 is limited to 270 degrees. The center of this rotation (radius 106) of the base seat 80, shown at point 105, is aligned opposite the outside corner of the building H by rotating the base seat 80 on the adjusting board 15. The base seat 80 is then firmly fixed to the adjusting board 15. As the rotation driving seat 40 rotates right or left the lamp 26 will not contact the walls forming the outside corner.

In some cases the center of rotation shown on the base seat 80 may vary somewhat in relation to the position of the stopper pin 48. The base seat 80 can easily be rotated on the adjusting board 16 to compensate for this internal misalignment to produce a very accurate horizontal rotation relative to the house or building H to which the porch light 10 is attached.

Figure 9:
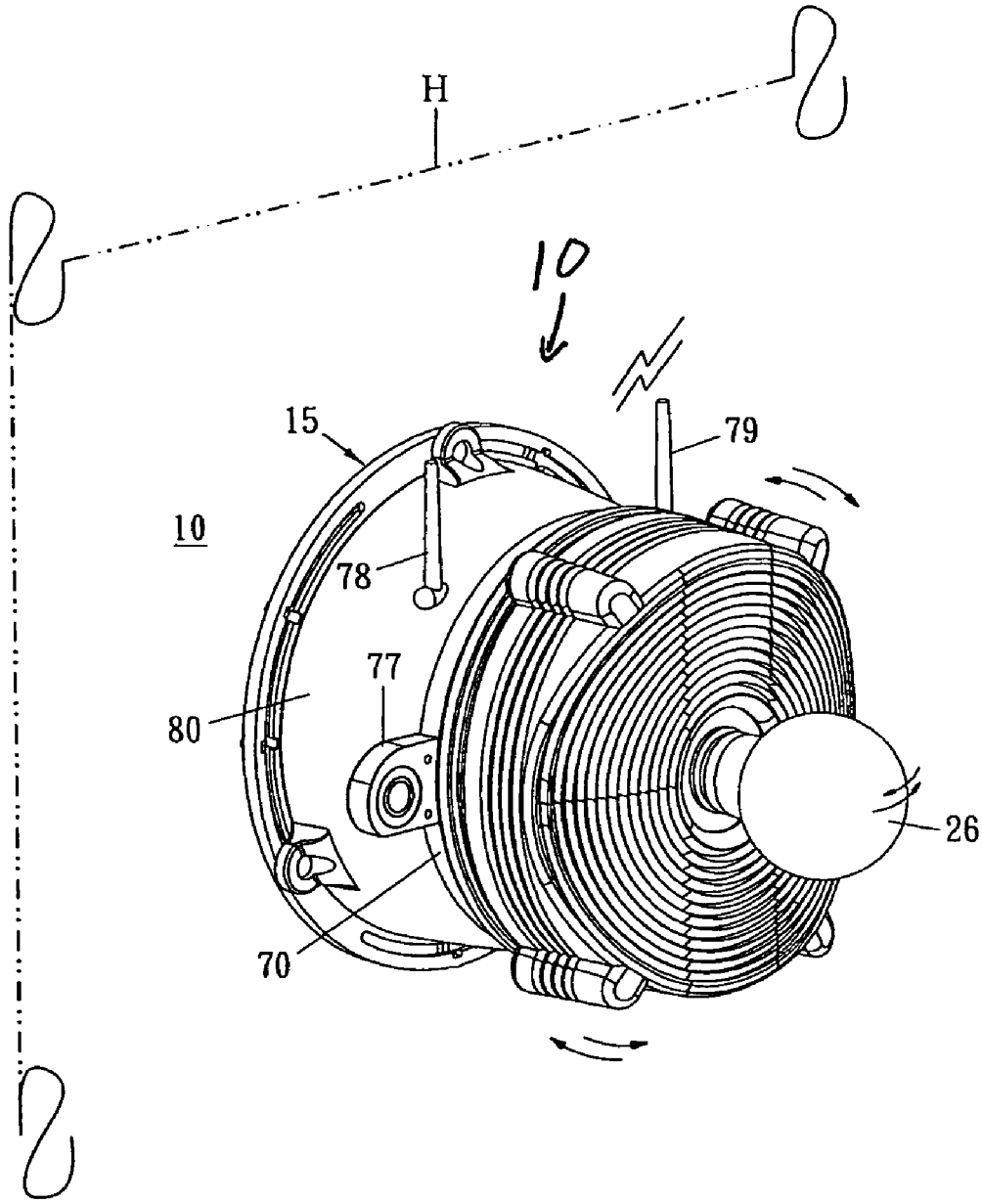
FIG. 9 shows further functions of the light to execute remote monitoring, surveillance, or videoing.

Referring to FIG. 9, other embodiments of the present invention include a wireless imaging/video camera 77 coupled to the rotation connecting seat 70 so that camera 77 can pan across about 90 to about 270 degrees. A wireless image signal receiver 78 and a wireless image signal transmitter 79 positioned on the base seat 80 can receive or transmit by wireless means image-information which can be processed in the printed circuit board 98. Accordingly, porch light 10 has further functions to execute remote monitoring, surveillance, or sending live video over communication networks, such as, for example, the Internet.

The wireless remote control porch light 10 of the present invention is, preferably, manually controlled with a hand-held transmitter (not shown) which is constructed and functions by methods well known in the art to activate the RF receiver 99 on circuit board 98 so that the three sets of electric wires 18 are selectively activated corresponding to the activating push-buttons of the hand-held manually operated RF transmitter.

The foregoing description has been limited to specific embodiments of this invention. It will be apparent, however, that variations and modifications may be made by those skilled in the art to the disclosed embodiments of the invention, with the attainment of some of all of its advantages and without departing from the spirit and scope of the present invention. For example, any suitable type of lamp housing can be attached to light bulb socket 34 to fix the angle of the light source 26 relative to the movable lamp holder 30. A sliding stopper pin arrangement or various types of electronic switches known in the art may be used in place of the stopper pins 48, 39 that are placed into the fixed holes 47, 38 to limit the degree of rotation of the rotation driving seat 40 and or movable lamp holder 30. Although the maximum degree of horizontal rotation of the rotation driving seat 40 is, preferably, less than 360 degrees, the degree of rotation could be greater than 360 degrees.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A remote controlled light, comprising:

a) a base seat and a lamp;

b) a fixed seat attached to said base seat said fixed seat having an internal ring gear;

c) a rotating connecting seat between said base seat and said fixed seat, said rotating connecting seat being rotatable on said base seat;

d) a rotation driving seat fitting within said base seat and being connected to said rotating connecting seat so that said rotation driving seat rotates within said base seat;

e) said rotation driving seat having a first reversible motor with a first driving gear, said first driving gear engaging said internal ring gear so that said first reversible motor can rotate said rotation driving seat and said lamp to the left or right about the central axis of said rotation driving seat;

f) a movable lamp holder attached rotatably to said rotation driving seat so that the axis of rotation of said movable lamp holder is approximately perpendicular to the central axis of said rotation driving seat;

g) said movable lamp holder having a gear rack and said rotation driving seat having a second reversible motor with a second driving gear, said second driving gear engaging said gear rack so that said second reversible motor can rotate said movable lamp holder and lamp up or down about the axis of rotation of said movable lamp holder; and (h) one or more stopper pins on said movable lamp holder to engage one or more stopper ribs in said rotation driving seat to limit the degree of rotation of said movable lamp holder.

2. A remote controlled light, comprising:

a) a base seat and a lamp;

b) a fixed seat attached to said base seat, said fixed seat having an internal ring gear;

c) a rotating connecting seat between said base seat and said fixed seat, said rotating connecting seat being rotatable on said base seat;

d) a rotation driving seat fitting within said base seat and being connected to said rotating connecting seat so that said rotation driving seat rotates within said base seat;

e) said rotation driving seat having a first reversible motor with a first driving gear, said first driving gear engaging said internal ring gear so that said first reversible motor can rotate said rotation driving seat and said lamp to the left or right about the central axis of said rotation driving seat; and f) an adjusting board which is attachable to a structure and which interfaces between said base seat and the structure to which said base seat is to be attached by means of said adjusting board, said base seat being attached rotatably to said adjusting board so that said base seat is rotatably adjustable to position said light within the center of its arc of rotation.

3. A remote controlled light, comprising:

a) a base seat and a lamp;

b) a fixed seat attached to said base seat, said fixed seat having an internal ring gear;

c) a rotating connecting seat between said base seat and said fixed seat, said rotating connecting seat being rotatable on said base seat;

d) a rotation driving seat fitting within said base seat and being connected to said rotating connecting seat so that said rotation driving seat rotates within said base seat;

e) said rotation driving seat having a first reversible motor with a first driving gear, said first driving gear engaging said internal ring gear so that said first reversible motor can rotate said rotation driving seat and said lamp to the left or right about the central axis of said rotation driving seat;

f) a movable lamp holder attached rotatably to said rotation driving seat so that the axis of rotation of said movable lamp holder is approximately perpendicular to the central axis of said rotation driving seat;

g) said movable lamp holder having a gear rack and said rotation driving seat having a second reversible motor with a second driving gear, said second driving gear engaging said gear rack so that said second reversible motor can rotate said movable lamp holder and lamp up or down about the axis of rotation of said movable lamp holder; and an adjusting board which is attachable to a structure and which interfaces between said base seat and the structure to which said base seat is to be attached by means of said adjusting board, said base seat being attached rotatably to said adjusting board so that said base seat is rotatably adjustable to position said light within the center of its arc of rotation.

4. A remote controlled light, comprising:

a) a base seat and a lamp;

b) a fixed seat attached to said base seat, said fixed seat having an internal ring gear;

c) a rotating connecting seat between said base seat and said fixed seat, said rotating connecting seat being rotatable on said base seat;

d) a rotation driving seat fitting within said base seat and being connected to said rotating connecting seat so that said rotation driving seat rotates within said base seat;

e) said rotation driving seat having a first reversible motor with a first driving gear, said first driving gear engaging said internal ring gear so that said first reversible motor can rotate said rotation driving seat and said lamp to the left or right about the central axis of said rotation driving seat;

f) a movable lamp holder attached rotatably to said rotation driving seat so that the axis of rotation of said movable lamp holder is approximately perpendicular to the central axis of said rotation driving seat;

g) said movable lamp holder having a gear rack and said rotation driving seat having a second reversible motor with a second driving gear, said second driving gear engaging said gear rack so that said second reversible motor can rotate said movable lamp holder and lamp up or down about the axis of rotation of said movable lamp holder;

h) said rotation driving seat having an RF receiver to receive wireless RF signals from an RF transmitter by which a user may remotely turn said lamp on or off, turn said first reversible motor on to rotate said rotation driving seat and lamp left or right, turn said second reversible motor on to rotate said movable lamp holder and lamp up or down, or turn said first and second reversible motors off, i) one or more stopper pins in said rotation driving seat to engage a stopper block on said internal ring gear to limit the degree of rotation of said rotation driving seat; and j) one or more stopper pins on said movable lamp holder to engage one or more stopper ribs in said rotation driving seat to limit the degree of rotation of said movable lamp holder.

5. A remote controlled light of claim 4 further comprising an adjusting board which is attachable to a structure and which interfaces between said base seat and the structure to which said base seat is to be attached by means of said adjusting board, said base seat being attached rotatably to said adjusting board so that said base seat is rotatably adjustable to position said light within the center of its arc of rotation.

6. A remote controlled light of claim 4 further comprising a waterproof seal which is attached to said rotation driving seat wherein said waterproof seal accommodates the rotational movement of said light.

7. A remote controlled light, comprising:

a) a base seat and a lamp;

b) a fixed seat attached to said base seat, said fixed seat having an internal ring gear;

c) a rotating connecting seat between said base seat and said fixed seat, said rotating connecting seat being rotatable on said base seat;

d) a rotation driving seat fitting within said base seat and being connected to said rotating connecting seat so that said rotation driving seat rotates within said base seat;

e) said rotation driving seat having a first reversible motor with a first driving gear, said first driving gear engaging said internal ring gear so that said first reversible motor can rotate said rotation driving seat and said lamp to the left or right about the central axis of said rotation driving seat;

f) a movable lamp holder attached rotatably to said rotation driving seat so that the axis of rotation of said movable lamp holder is approximately perpendicular to the central axis of said rotation driving seat;

g) said movable lamp holder having a gear rack and said rotation driving seat having a second reversible motor with a second driving gear, said second driving gear engaging said gear rack so that said second reversible motor can rotate said movable lamp holder and lamp up or down about the axis of rotation of said movable lamp holder;

h) said rotation driving seat having an RF receiver to receive wireless RF signals from an RF transmitter by which a user may remotely turn said lamp on or off, turn said first reversible motor on to rotate said rotation driving seat and lamp left or right, turn said second reversible motor on to rotate said movable lamp holder and lamp up or down, or turn said first and second reversible motors off, i) one or more stopper pins in said rotation driving seat to engage a stopper block on said internal ring gear to limit the degree of rotation of said rotation driving seat;

j) one or more stopper pins on said movable lamp holder to engage one or more stopper ribs in said rotation driving seat to limit the degree of rotation of said movable lamp holder;

k) an adjusting board which is attachable to a structure and which interfaces between said base seat and the structure to which said base seat is to be attached by means of said adjusting board, said base seat being attached rotatably to said adjusting board so that said base seat is rotatably adjustable to position said light within the center of its arc of rotation; and l) a waterproof seal which is attached to said rotation driving seat wherein said waterproof seal accommodates the rotational movement of said light.

* * * * *